US009047823B2

(12) United States Patent
Kim et al.

(10) Patent No.: US 9,047,823 B2
(45) Date of Patent: Jun. 2, 2015

(54) ORGANIC LIGHT EMITTING DISPLAY AND METHOD OF ERASING AFTERIMAGE THEREOF

(71) Applicant: LG DISPLAY CO., LTD., Seoul (KR)

(72) Inventors: Joonyoung Kim, Paju-si (KR); Hyunki Lee, Paju-si (KR); Munjun Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 126 days.

(21) Appl. No.: 13/725,697

(22) Filed: Dec. 21, 2012

(65) Prior Publication Data

US 2014/0092144 A1 Apr. 3, 2014

(30) Foreign Application Priority Data

Sep. 28, 2012 (KR) ..... 10-2012-0108967
Nov. 20, 2012 (KR) ..... 10-2012-0131463

(51) Int. Cl.
*G09G 3/30* (2006.01)
*G09G 3/32* (2006.01)

(52) U.S. Cl.
CPC ..... *G09G 3/3291* (2013.01); *G09G 3/3233* (2013.01); *G09G 2330/02* (2013.01)

(58) Field of Classification Search
CPC ..... G09G 3/30–3/3291; G09G 2310/0248; G09G 2310/0251; G09G 2330/02; G09G 2330/021
USPC ..... 345/204–214, 690–699, 76–83; 315/169.3
See application file for complete search history.

(56) References Cited

U.S. PATENT DOCUMENTS

| | | | | |
|---|---|---|---|---|
| 5,155,613 | A * | 10/1992 | Sakayori | 345/97 |
| 5,903,260 | A * | 5/1999 | Imamura | 345/211 |
| 5,952,990 | A * | 9/1999 | Inoue et al. | 345/97 |
| 7,109,965 | B1 * | 9/2006 | Lee et al. | 345/98 |
| 7,336,269 | B2 | 2/2008 | Huang et al. | |
| 2006/0066550 | A1 * | 3/2006 | Huang et al. | 345/92 |
| 2009/0109147 | A1 | 4/2009 | Park et al. | |
| 2009/0201231 | A1 | 8/2009 | Takahara et al. | |
| 2011/0122119 | A1 * | 5/2011 | Bae et al. | 345/211 |
| 2012/0056870 | A1 * | 3/2012 | Koh | 345/215 |
| 2014/0022289 | A1 * | 1/2014 | Lee et al. | 345/691 |

FOREIGN PATENT DOCUMENTS

| | | | |
|---|---|---|---|
| EP | 0 316 801 | B1 | 9/1994 |
| JP | 1-170986 | A | 7/1989 |
| JP | 2002-169509 | A | 6/2002 |
| JP | 2005-106998 | A | 4/2005 |
| JP | 2008-299025 | A | 12/2008 |
| JP | 2009-109984 | A | 5/2009 |
| JP | 2009-271392 | A | 11/2009 |
| JP | 2009-276744 | A | 11/2009 |

* cited by examiner

*Primary Examiner* — Dmitriy Bolotin
(74) *Attorney, Agent, or Firm* — Birch, Stewart, Kolasch & Birch, LLP

(57) ABSTRACT

An organic light emitting display and a method of erasing an image sticking thereof are provided. In the image sticking erasing method, a panel driving circuit is driven by a logic power voltage during a power-off delay time to discharge pixels.

20 Claims, 12 Drawing Sheets

ORGANIC LIGHT EMITTING DISPLAY AND METHOD OF ERASING AFTERIMAGE THEREOF

This application claims the benefit of Korean Patent Application No. 10-2012-0108967 filed on Sep. 28, 2012 and Korean Patent Application No. 10-2012-0131463 on Nov. 20, 2012, the entire contents of all these applications are herein by reference for all purposes as if fully set forth herein.

BACKGROUND

1. Field

This document relates to an organic light emitting display and a method of erasing an image sticking thereof.

2. Related Art

Pixels of an organic light emitting display each comprises an organic light emitting diode (hereinafter, referred to as "OLED") which is a self-luminous element. The OLED comprises organic compound layers such as a hole injection layer HIL, a hole transport layer HTL, an emission layer EML, an electron transport layer ETL, and an electron injection layer EIL, which are stacked. The OLED emits light when electrons and holes are combined in an organic layer by allowing current to flow through a fluorescent or phosphorous organic thin film.

An organic light emitting diode display may have an image sticking after power-off, and the image sticking may last for a long time. This image sticking problem occurs because the organic light emitting diode display cannot discharge residual charges in pixels upon power-off. An image sticking of the organic light emitting diode can be seen even when the power is turned off, and can last and be seen even after the power is turned on to drive the display panel over again.

SUMMARY

The present invention has been made in an effort to provide an organic light emitting display capable of preventing an image sticking in a power-off sequence process and a method of erasing an image sticking thereof.

An exemplary embodiment of the present invention provides an organic light emitting display comprising: a display panel having data lines, gate lines crossing the data lines, and pixels comprising organic light emitting diodes; a panel driving circuit for writing data to the display panel; and a power supply unit which generates a logic power supply voltage required to drive the panel driving circuit, maintains the output of the logic power supply voltage until a predetermined period of power-off delay time has elapsed after the power input signal decreases from a high logic level to a low logic level, and drops the logic power supply voltage after the power-off delay time.

The panel driving circuit senses a change in the power input signal, and is driven by the logic power supply voltage during the power-off delay time to supply preset black data to the pixels or supply gate signals to the pixels to discharge the pixels.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION

Figure 1:
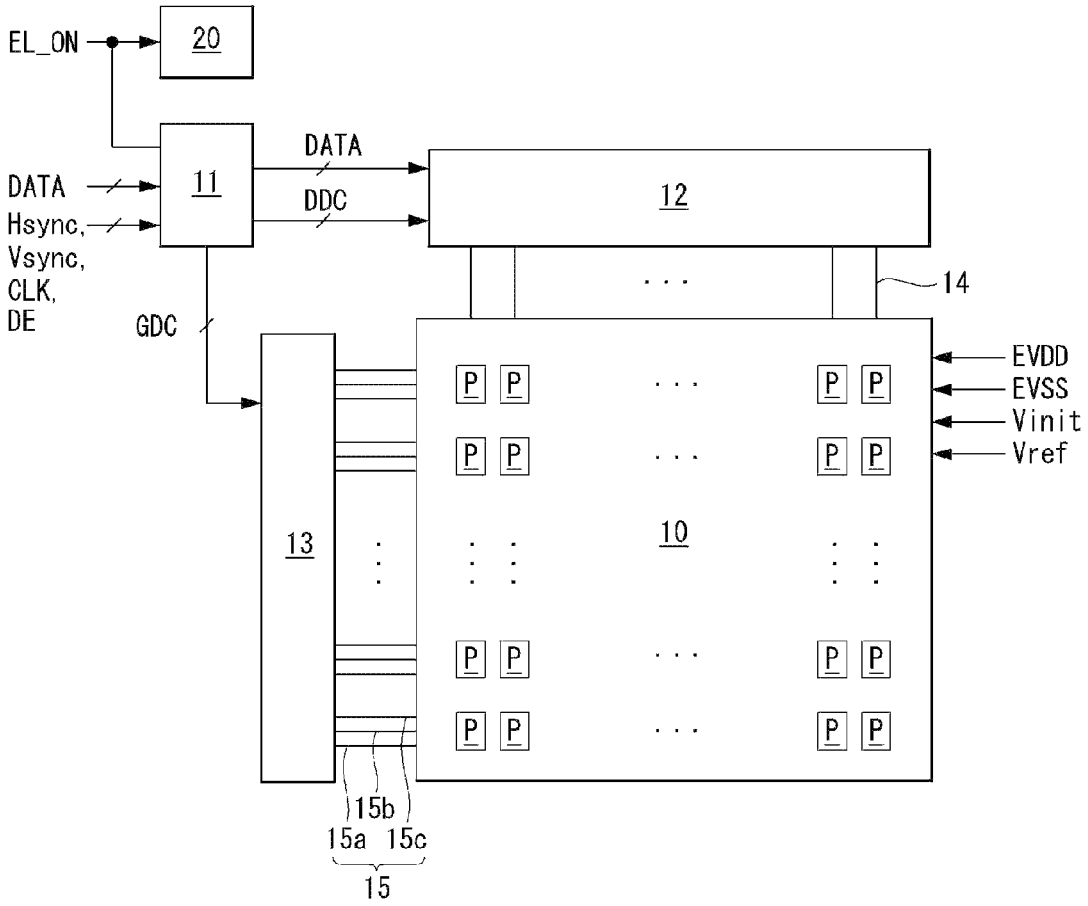
FIG. 1 is a block diagram showing an organic light emitting display exemplary embodiment of the present invention.

Hereinafter, exemplary embodiments according to the present invention will be described in detail with reference to the attached drawings. Throughout the specification, like reference numerals denote substantially like components. In the following description, if it is decided that the detailed description of known function or configuration related to the invention makes the subject matter of the invention unclear, the detailed description is omitted.

Referring to FIG. 1, organic light emitting display according to an exemplary embodiment of the present invention comprises a display panel 10, a panel driving circuit for writing data to the display panel 10, and a power supply unit 20 for generating power required to drive the panel driving circuit.

The panel driving circuit comprises a data driving circuit 12, a gate driving circuit 13, and a timing controller 11. The panel driving circuit senses a change in a power input signal EL_ON and decides a power-off start point in time. The panel driving circuit is additionally driven upon receiving a logic power supply voltage during a power-off delay time to thereby write preset black data to the pixels so as to erase an image sticking, irrespective of an input image, or, the panel driving circuit initializes the pixels during the power-off delay time and suppresses light emission of the pixels. The power-off delay time is a period of time during which the logic power supply voltage (12V) is maintained after the power-off start point in time.

The display panel 10 has a plurality of data lines 14 and a plurality of gate lines 15 crossing the plurality of data lines 14. Pixels P are disposed in a matrix defined by the crossing of the data lines 14 and the gate lines 15. The gate lines 15 comprises scan lines 15*a*, emission lines 15*b*, and initialization lines 15*c*. Each of the pixels P may be formed as a circuit consisting of an OLED, a driving TFT, four switching TFTs, and two capacitors, but the present invention is not limited thereto. For instance, each of the pixels P may be implemented as any well-known circuit which comprises an OLED, a driving element for controlling the current flowing through the OLED in accordance with a data voltage, one or more switching elements, and one or more capacitors, and causes the OLED to emit light in response to an emission control signal after supplying a data voltage to a gate of the driving element in response to a scan pulse.

The timing controller 11 realigns digital video data RGB received from an external host system in accordance with a pixel array of the display panel 10 and supplies it to the data driving circuit 12. The host system may be implemented as any one of the following: a TV system, a set-top box, a navigation system, a DVD player, a Blue-ray player, a personal computer (PC), a home theater system, a phone system, etc. The host system transmits digital video data of an input image and timing signals Vsync, Hsync, CLK, and DE to the timing controller 11 in synchronization with the data RGB.

The timing controller 11 generates a source timing control signal DDC for controlling an operation timing of the data driving circuit 12 and a gate timing control signal GDC for controlling an operation timing of the gate driving circuit 13 based on timing signals such as a vertical synchronization signal Vsnc, a horizontal synchronization signal Hsync, a main clock signal CLK, and a data enable signal DE. The gate timing control signal GDC comprise a gate start pulse, a gate shift clock signal, a gate output enable signal, etc. The data timing control signal comprise a source start pulse, a source sampling clock, a polarity control signal, a source output enable signal, etc. The gate timing control signal comprises a gate start pulse GSP for defining a start timing of gate signals, a shift clock GSC for defining a shift timing of gate signals, and a gate output enable signal GOE for defining an output timing of gate signals.

Figure 5:
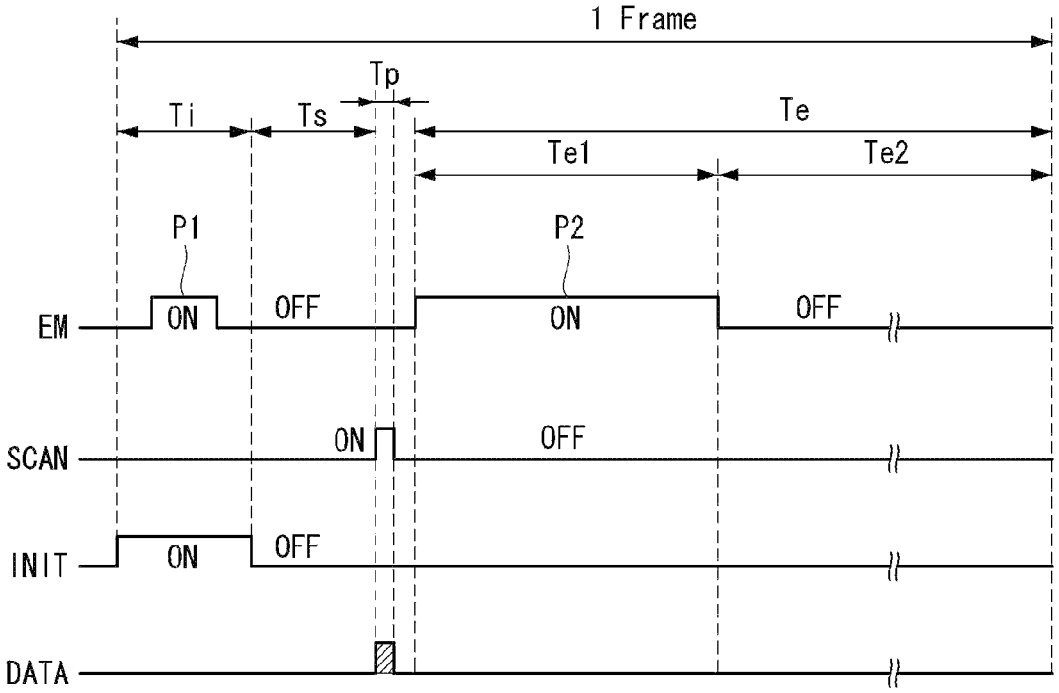
FIG. 5 is a waveform diagram showing an operation of pixels P that display an input image properly in a power-on state.

The data driving circuit 12 converts the digital video data RGB input from the timing controller 11 into a gamma compensation voltage to generate an analog data voltage, and supplies the data voltage to the data lines 14. The gate driving circuit 13 generates gate signals under the control of the timing controller 11, and sequentially shifts the gate signals for each row line of the pixel array. As shown in FIG. 5, the gate signals may comprise, but not limited to, a scan signal SCAN, an emission control signal EM, and an initialization signal INIT. The gate driving circuit 13 sequentially supplies the scan signal SCAN, in synchronization with a data voltage, under the control of the timing controller 11, and sequentially supplies the emission control signal EM to the emission lines 15*b*. Also, the gate driving circuit 13 sequentially supplies the initialization signal NIT to the initialization lines 15*c* in a line sequential method. The scan signal SCAN, the emission control signal EM, and the initialization signal INIT swing between a gate high voltage VGH and a gate low voltage VGL. The gate high voltage VGH is set to a voltage higher than the threshold voltage of the switching TFTs formed in the pixels P, whereas the gate low voltage VGL is set to a voltage lower than the threshold voltage of the switching TFTs formed in the pixels P.

The power supply unit 20 generates a logic power supply voltage for driving the panel driving circuit when a power input signal EL_ON is input at a high logic voltage. The power supply unit 20 may generate a power supply voltage EVDD, a low-potential power supply voltage EVSS, a reference voltage Vref, and an initialization voltage Vinit in a power-on state in which the power input signal EL_ON is maintained at a high logic level. The power supply unit 20 drops the high-potential power supply voltage EVDD to the ground potential or 0 V when the power input signal EL_ON is pulled down to a low logic voltage, then maintains the output of the logic power supply voltage to 12 V so that the panel driving circuit operates normally during a power-off delay time (Toff of FIG. 3), and then drops the logic power supply voltage to the ground potential or 0 V. When the high-potential power supply voltage EVDD is dropped to the ground potential, no current flows through the OLEDs of the pixels P and hence the pixels P do not emit light.

The power input signal EL_ON is a 3.3V TTL (Transistor Transistor Logic) voltage swinging between 3.3 V and 0 V, and indicates the power state of the organic light emitting display. When the power of the organic light emitting display is turned on and goes into a power-on state, the power input signal EL_ON is maintained at the high logic level of 3.3 V until the power of the organic light emitting display is switched to a power-off state. The power-off state occurs when the power of the organic light emitting display is turned off by the user or due to other reasons. In the power-off state, driving voltages of the organic light emitting display are sequentially turned off in accordance with a predetermined power off sequence. The power input signal EL_ON is dropped to a low logic level of 0 V when the power of the organic light emitting display is switched to the power-off state.

The logic supply power voltage is 12 V. The power supply unit 20 maintains the logic power supply voltage at 12 V during the power-off delay time Toff which lasts until a predetermined period of time has elapsed from the power-off start point in time, and then does not generate the output of the logic power supply voltage of 12 V. Accordingly, the panel driving circuit operates normally during the power-off delay time Toff in the power-off sequence process, and then is disabled and stops its operation because the logic power supply voltage of 12 V is not subsequently input. The power-off delay time Toff is 1 frame long or more, and may be set to, but not limited to, approximately 50 msec.

Figure 2:
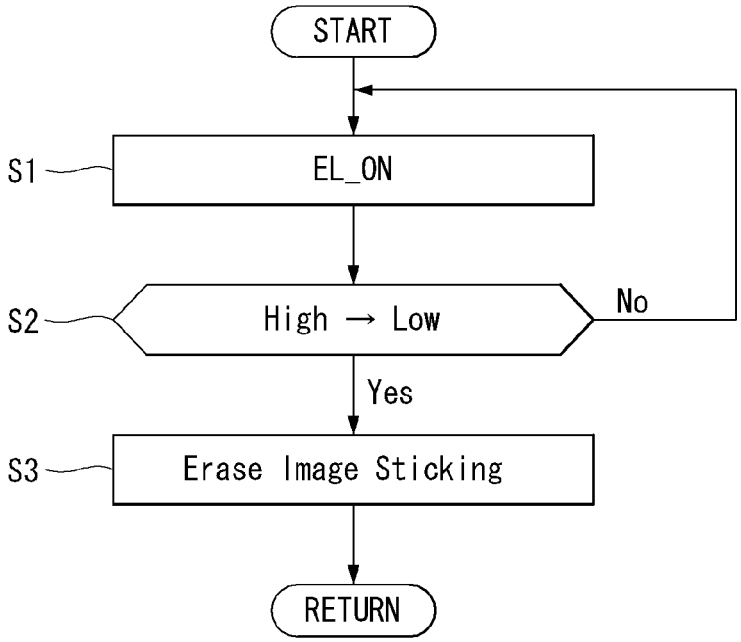
FIG. 2 is a flowchart showing by steps the control flow of a method of erasing an image sticking of an organic light emitting display according to an exemplary embodiment of the present invention.

The timing controller 11 erases an image sticking left on the pixel array of the display panel 10 in the power-off sequence process by controlling the data driving circuit 12 and the gate driving circuit 13. FIG. 2 is a flowchart showing by steps the control flow of the method of erasing an image sticking of an organic light emitting display according to an exemplary embodiment of the present invention.

Referring to FIG. 2, the timing controller 11 senses a change in the power input signal EL_ON and detects that power off is started when the power input signal decreases to a predetermined reference value or less (S1 and S2). The timing controller 11 erases an image sticking left on the pixel array by controlling the data driving circuit 12 and the gate driving circuit 13 during the power-off delay time Toff after the power-off start point in time (S3). The image sticking can be erased by the following image sticking erasing methods of first and second exemplary embodiments. Since the high-potential power supply voltage EVDD is not applied to the pixels P after the power-off start point in time, the pixels P do not emit light because current does not flow through the OLEDs. Accordingly, the pixels P are discharged while emitting no light, thereby erasing the image sticking. The user cannot perceive the discharge of the pixels P after power-off because the pixels do not emit light and look black after power-off.

First Exemplary Embodiment

In the first exemplary embodiment, the timing controller 11 transmits black data to the data driving circuit 12 during at least 1 frame period, and drives the data driving circuit 12 and the gate driving circuit 13 to write the black data to the pixels P. The black data is stored in the timing controller 11 for the purpose of erasing an image sticking in the power-off sequence process, irrespective of input image data. In the timing controller 11, the black data may be set to digital data "$00000000_2$" having a black gray scale value and stored in a register. The black data may be set to a dark gray scale, for example, "$0000XXXX_2$", similar to the black gray scale. Here, X is 0 or 1. The timing controller 11 reads the black data from the register at the start of power-off and transmits it to the data driving circuit 12. In the first exemplary embodiment, the data driving circuit 12 is additionally driven during the power-off delay time Toff to convert the black data input from the timing controller 11 into a gamma compensation voltage, generate a black data voltage, and supply the black data voltage to the data line 14. In the first exemplary embodiment, the gate driving circuit 13 is additionally driven during the power-off delay time Toff to generate a scan signal SCAN, an emission signal EM, and an initialization INIT under the control of the timing controller 11. Residual charges in the pixels P are discharged through the data lines when a black data voltage is supplied within the power-off delay time Toff. Accordingly, an image sticking of the pixels P is erased within the power-off delay time Toff.

The timing controller 11 may repeatedly write the black data to the pixels P during N frame periods (N is a positive integer) within the power-off delay time Toff in the power-off sequence process.

Second Exemplary Embodiment

In the second exemplary embodiment, the timing controller 11 may modulate the gate timing control signal GDC to suppress light emission of the pixels P. The gate timing control signal GDC comprises start pulses for indicating the start timing of a scan signal SCAN, an emission control signal EM, and an initialization signal NIT and clock signals for indicating the shift timing of these signals. In the second exemplary embodiment, the timing controller 11 modulates the gate timing control signal GDC to initialize the pixels P and suppress light emission of the pixels P.

Figure 7:
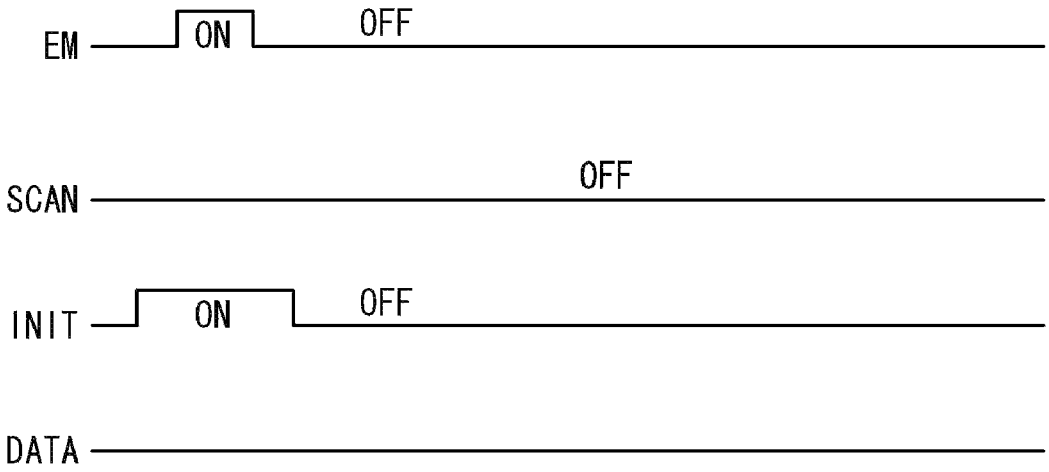
FIGS. 7 and 8 are waveform diagrams for explaining an operation of erasing an image sticking by initializing pixels and suppressing light emission in a method of erasing an image sticking of an organic light emitting display according to a second exemplary embodiment of the present invention.

In the second exemplary embodiment, the timing controller 11 supplies no data to the data driving circuit 12. The data driving circuit 12 outputs no data voltage in the power-off sequence process according to the second exemplary embodiment. In the second exemplary embodiment, the gate driving circuit 13 sequentially supplies only signals required to initialize the pixels P under the control of the timing controller 11, and outputs no emission control signal (EM (P2) of FIG. 5) for controlling the emission timing of the pixels P. When signals required to initialize the pixels P, for example, EM and INIT of FIG. 7, are applied to the pixels P, some of the TFTS of the pixels P are turned on. Residual charges in the pixels P are discharged through the turned-on TFTs within the power-off delay time Toff.

Figure 3:
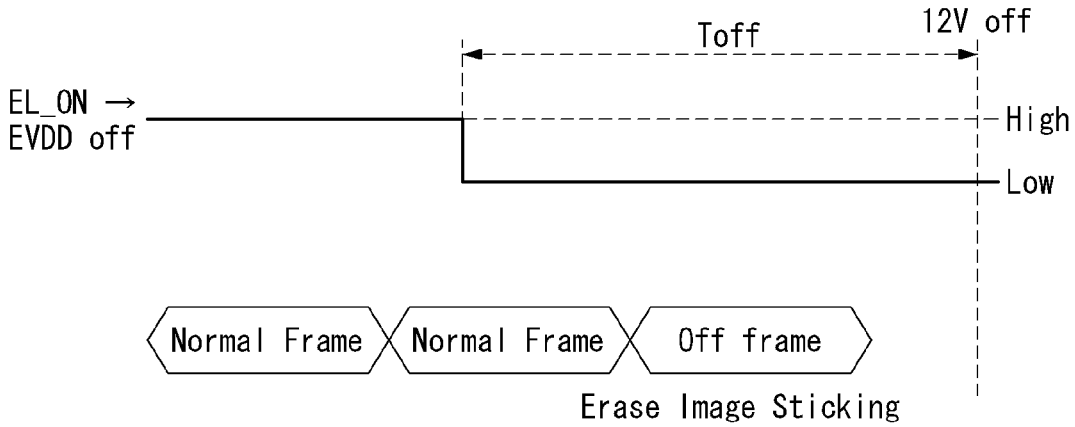
FIG. 3 is a waveform diagram showing a power-off delay time in a power-off sequence process.

FIG. 3 is a waveform diagram showing a power-off delay time Toff in a power-off sequence process.

Referring to FIG. 3, the timing controller 11 transmits digital video data of an input image to the data driving circuit 12 in the power-on state in which the power input signal EL_ON is maintained at a high logic level, and controls the data driving circuit 12 and the gate driving circuit 13 in an appropriate manner to write the data of the input image to the pixels P. The data in the pixels P is updated every frame period. In FIG. 3, a normal frame refers to 1 frame period during which input image data is written to the pixels P in the power-on state.

The timing controller 111 detects that power-off is started when the power input signal EL_ON changes to the low logic level, and controls the data driving circuit 12 and the gate driving circuit 13 during the power-off delay time Toff to erase an image sticking left on the pixel array. In FIG. 3, an off frame refers to 1 frame period during which black data is written to the pixels P in the power-off sequence process or the emission control signal is not generated to thereby suppress light emission of the pixels P and erase an image sticking. One or more off frame periods may be allocated within the power-off delay time Toff.

Figure 4:
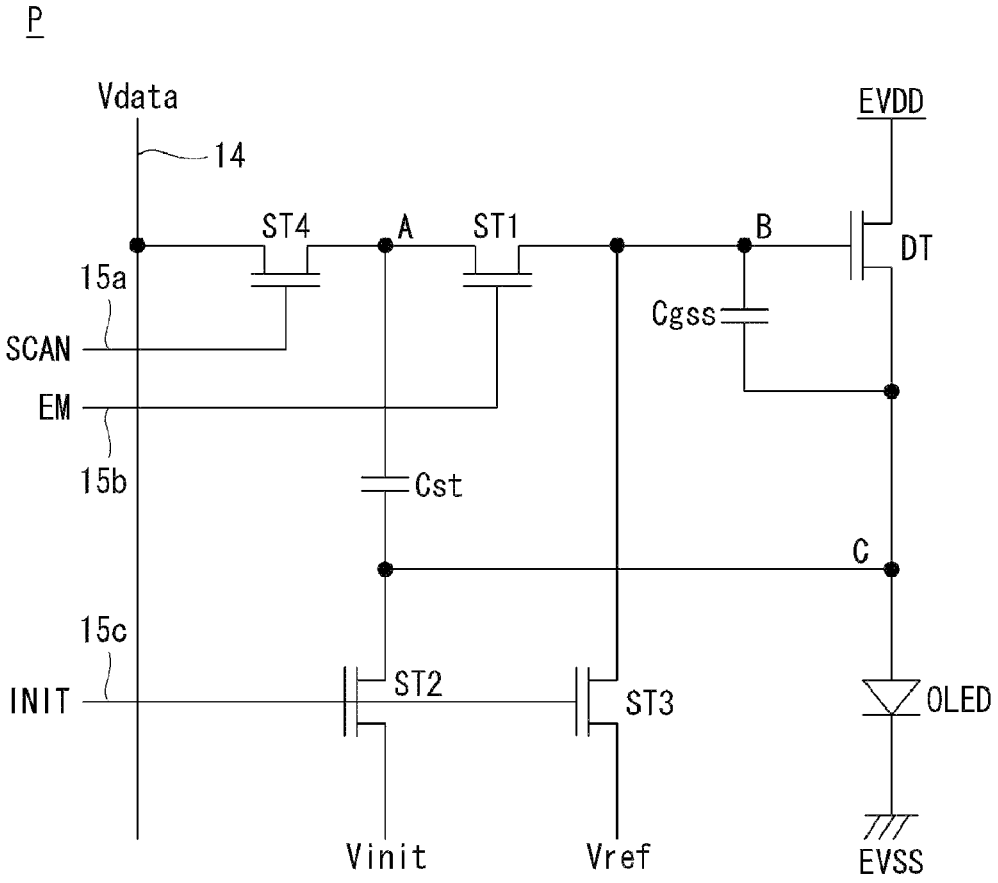
FIG. 4 is a circuit diagram showing an example of a pixel.

As shown in FIG. 4, each of the pixels P may be connected to the data lines 14, the scan lines 15*a*, the emission lines 15*b*, and the initialization lines 15*c*. Each of the pixels P receives a pixel driving voltage such as a high-potential power supply voltage EVDD, a low-potential power supply voltage EVSS, a reference voltage Vref, and an initialization voltage Vinit. The reference voltage Vref and the initialization voltage Vinit may be set to be lower than the low-potential power supply voltage EVSS. The difference between the reference voltage Vref and the initialization voltage Vinit may be set to be higher than the threshold voltage of the driving TFT DT. The high-potential power supply voltage EVDD, the low-potential power supply voltage EVSS, the reference voltage Vref, and the initialization voltage Vinit may be generated from a host system or the power supply unit 20.

If the input image data in the pixels P is updated at a point in time when the power input signal EL_ON changes to the low logic level, the timing controller 11 may erase the image sticking after writing all the remaining data to the pixels P as shown in FIG. 3.

FIG. 4 is a circuit diagram showing an example of a pixel P. FIG. 5 is a waveform diagram showing an operation of pixels P that display an input image properly in a power-on state.

Referring to FIG. 4 and FIG. 5, a pixel P comprises an OLED, a driving TFT DT, first to fourth switching TFTs ST1 to ST4, a compensation capacitor Cgss, and a storage capacitor Cst.

The OLED emits light by current supplied from the driving TFT DT. Organic compound layers are stacked between the anode and cathode of OLED. The organic compound layers of the OLED may comprise a hole injection layer HIL, a hole transport layer HTL, an emission layer EML, an electron transport layer ETL, and an electron injection layer EIL, but the present invention is not limited thereto and any well-known OLED structure is applicable.

The driving TFT DT controls current flowing through the OLED by a gate-source voltage. A gate electrode of the driving TFT DT is connected to node B, a drain electrode thereof is connected to an input terminal of a high-potential cell driving voltage EVDD, and a source electrode thereof is connected to node C.

The first switching TFT ST1 switches a current path between node A and node B in response to an emission control signal EM. The first switching TFT ST1 is turned on to transmit a data voltage Vdata stored in node A to node B. A gate electrode of the first switching TFT ST1 is connected to the emission line 15*b*, a drain electrode thereof is connected to node A, and a source electrode thereof is connected to node B.

The second switching TFT ST2 switches a current path between an input terminal of an initialization voltage Vinit and node C in response to an initialization signal NIT. The second switching TFT ST2 is turned on to supply the initialization voltage Vinit to node C. A gate electrode of the second switching TFT ST2 is connected to the initialization line 15*c*, a drain electrode thereof is connected to the input terminal of the initialization voltage Vinit, and a source electrode thereof is connected to node C.

The third switching TFT ST3 switches a current path between an input terminal of a reference voltage Vref and node B in response to the initialization signal NIT. The third switching TFT ST3 is turned on to supply the reference voltage Vref to node B. A gate electrode of the third switching TFT ST3 is connected to the initialization line 15*c*, a drain electrode thereof is connected to the input terminal of the reference voltage Vref, and a source electrode thereof is connected to node B.

The fourth switching TFT ST4 switches a current path between the data line 14 and node A in response to a scan signal SCAN. The fourth switching TFT ST4 is turned on to supply the data voltage Vdata to node A. A gate electrode of the fourth switching TFT ST4 is connected to the scan line 15*a*, a drain electrode thereof is connected to the data line 14, and a source electrode thereof is connected to node A.

The compensation capacitor Cgss is connected between node B and node C. The compensation Cgss enables a source follower method upon detecting the threshold voltage of the driving TFT DT, and contributes to improving threshold voltage compensation capability.

The storage capacitor Cst is connected between node A and node C. The storage capacitor Cst stores the data voltage Vdata input to node A and transmits it to node C.

An operation of the pixel P is divided into an initialization period Ti for initializing nodes A, B, and C, a sensing period Ts for detecting and storing the threshold voltage of the driving TFT DT, a programming period Tp for applying the data voltage Vdata to pixel P, and an emission period Te for supplying current to the OLED through the driving TFT DT to be driven in accordance with the data voltage Vdata which is not affected by the threshold voltage of the driving TFT DT. The emission period Te may be divided into first and second emission periods Te1 and Te2.

In the initialization period Ti, the second and third switching TFTs ST2 and ST3 are simultaneously turned on in response to an initialization signal NIT of high logic level. The first switching TFT ST1 is turned on in response to a first pulse P1 of an emission control signal EM in the initialization period Ti. The first pulse P1 of the emission control signal EM overlaps the initialization signal INIT. Preferably, pulses of the initialization signal INIT are wider than the first pulse P1 of the emission control signal EM. As a result, in the initialization period Ti, an initialization voltage Vinit is supplied to node C, and a reference voltage Vref is supplied to node B. Also, the reference voltage Vref is supplied to node A via the first and third switching TFTs ST1 and ST3. The fourth switching TFT ST4 maintains the off state in the initialization period Ti. The reference voltage VRef is set to be higher than the initialization voltage Vinit to make the gate voltage of the driving TFT DT higher than the source voltage so that the current path between the drain and source of the driving TFT DT becomes conductive.

The initialization voltage Vinit is set to an appropriately low value so as to prevent light emission of the OLED in the other periods Ti, Ts, and Tp except the emission period Te. For example, if the cell driving voltage EVDD is set to 20 V and the low-potential cell driving voltage EVSS is set to 0 V, the reference voltage Vref and the initialization voltage Vinit may be set to −1 V and −5 V, respectively.

The scan signal SCAN, emission control signal EM, and initialization signal INIT shown in FIG. 5 are grouped together, and supplied to a group of gate lines comprising the scan line 15*a*, the emission line 15*b*, and the initialization line 15*c* to select one line of the pixel array. These signals SCAN, EM, and NIT are supplied to the gate lines 15 as they are shifted for each row line of the pixel array.

In the sensing period Ts, the emission control signal EM and the initialization signal INIT are inverted to the low logic level. The scan signal SCAN is maintained at the low logic level in the sensing period Ts. As a result, the first to fourth switching TFTs ST1, ST2, ST3, and ST4 are maintained in the off state during the sensing period Ts, and the current Idt flowing through the driving TFT DT gradually decreases. When the gate-source voltage of the driving TFT DT reaches the threshold voltage Vth of the driving TFT DT, the driving TFT DT is turned off. At this point, the threshold voltage Vth of the driving TFT DT is detected by the source follower method and charged in node C.

In the programming period Tp, the fourth switching TFT ST4 is turned on by a scan signal SCAN of high logic level, in synchronization with the data voltage Vdata of the input image. At this point, the data voltage Vdata is supplied to node A. The first to third switching TFTs ST1, ST2, and ST3 are maintained in the off state during the programming period Tp. In the programming period Tp, nodes B and C are separate from node A by a TFT or a capacitor, so the potential in the sensing period Ts is maintained almost the same.

In the first emission period Te1, the first switching TFT ST1 is turned on by the second pulse P2 of the emission control signal EM. At this point, the data voltage Vdata charged in node A is transmitted to node B. The second to fourth switching TFTs ST2, ST3, and ST4 are maintained in the off state during the first emission period Te1. The driving TFT DT supplies current proportional to the data voltage Vdata transmitted to node B to the OLED in the first emission period Te1. During the first emission period Te1, when the current flowing through the driving TFT DT causes the potential of node C to rise up to the threshold voltage of the OLED or higher, the voltage increases up to "Voled" at which the OLED becomes conductive. As a result, the OLED is turned on and emits light.

In the second emission period Te2, the first to fourth switching TFTs ST1, ST2, ST3, and ST4 are maintained in the off state. The second emission period Te2 is set to prevent deterioration of the first switching TFT ST1 to which the emission control signal EM is applied. To this end, the emission control signal EM is inverted to the low logic level during the second emission period Te2 in order to compensate for a gate bias stress of the first switching TFT ST1.

The pixels P, if implemented as the circuit of FIG. 4, detect the threshold voltage of the driving TFT DT in accordance with the source follower method. The source follower method allows the compensation capacitor to be connected between the gate and source of the driving TFT DT and makes the source voltage of the driving TFT to follow the gate voltage upon detecting the threshold voltage. Moreover, the source follower method makes it possible to detect a threshold voltage having a negative value, as well as a positive threshold voltage value of the driving TFT DT, because a high-potential cell driving voltage EVDD is supplied to the drain of the driving TFT DT, separately from the gate. The pixels P allow the gate of the driving TFT DT to float upon sensing the threshold voltage of the driving TFT DT, and use the compensation capacitor Cgss connected between the gate and source of the driving TFT DT and a parasitic capacitor of the driving TFT DT to thereby improve threshold voltage compensation capability. By reducing the on-duty of the emission control signal EM, deterioration of the switching TFT ST1 to be switched in accordance with the emission control signal EM can be minimized.

Figure 6:
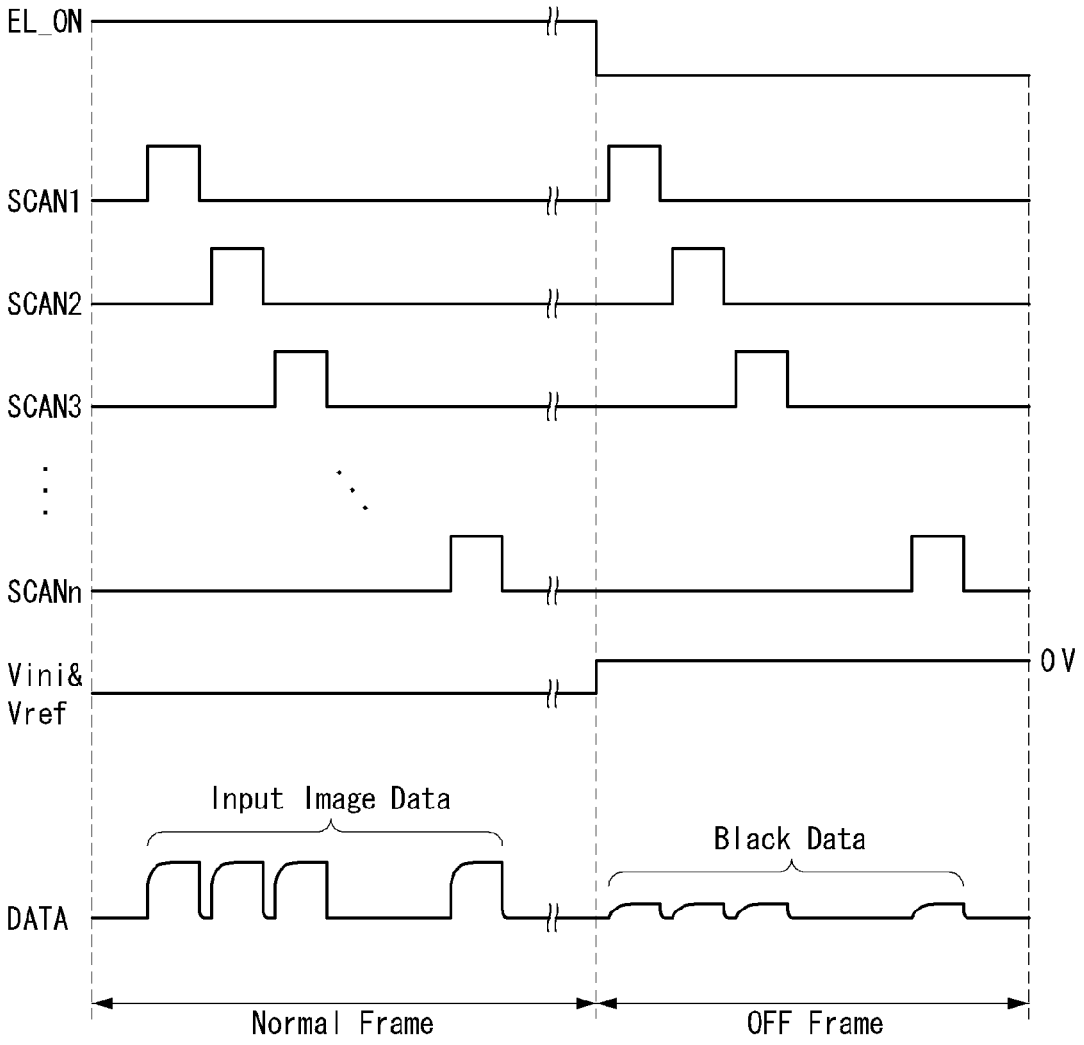
FIG. 6 is a waveform diagram for explaining an operation of writing black data to erase an image sticking in pixels in a method of erasing an image sticking of an organic light emitting display according to a first exemplary embodiment of the present invention.

FIG. 6 is a waveform diagram for explaining an operation of writing black data to erase an image sticking in pixels in a method of erasing an image sticking of an organic light emitting display according to a first exemplary embodiment of the present invention. The emission control signal EM and the initialization signal NIT, among the gate signals of FIG. 6, are omitted.

Referring to FIG. 6, in the power-on state, the gate driving circuit 13 sequentially supplies scan signals SCAN1 to SCANn, in synchronization with a data voltage of an input image, to the scan lines 15*a* under the control of the timing controller 11. Accordingly, data of the input image is written to the pixels P in the power-on state.

The timing controller 11 transmits digital black data to the data driving circuit 12 within the power-off delay time Toff after the power input signal EL_ON changes to the low logic level. The digital black data is preset to erase an image sticking, irrespective of input image data, and induces discharge of the pixels P within the power-off delay time Toff after the start of power-off.

The data driving circuit 12 converts the digital black data into a gamma compensation voltage to generate a black data voltage and supply the black data voltage to the data lines 14. The gate driving circuit 13 sequentially supplies scan signals SCAN1 to SCANn, in synchronization with the black data voltage, to the scan lines 15*a* under the control of the timing controller 11 within the power-off delay time Toff. Accordingly, the black data is written to the pixels P in the power-off sequence process. Since the black data is written to the pixels P, an image sticking is erased.

If the reference voltage Vref and the initialization voltage Vinit are maintained at a negative polarity voltage or positive polarity voltage after the start of power-off, unnecessary charges may be accumulated in the pixels P. The reference voltage Vref and the initialization voltage Vinit change to the ground voltage or 0 V. Accordingly, nodes A, B, and C of the pixels P are discharged to the ground potential after the start of power-off.

Figure 8:
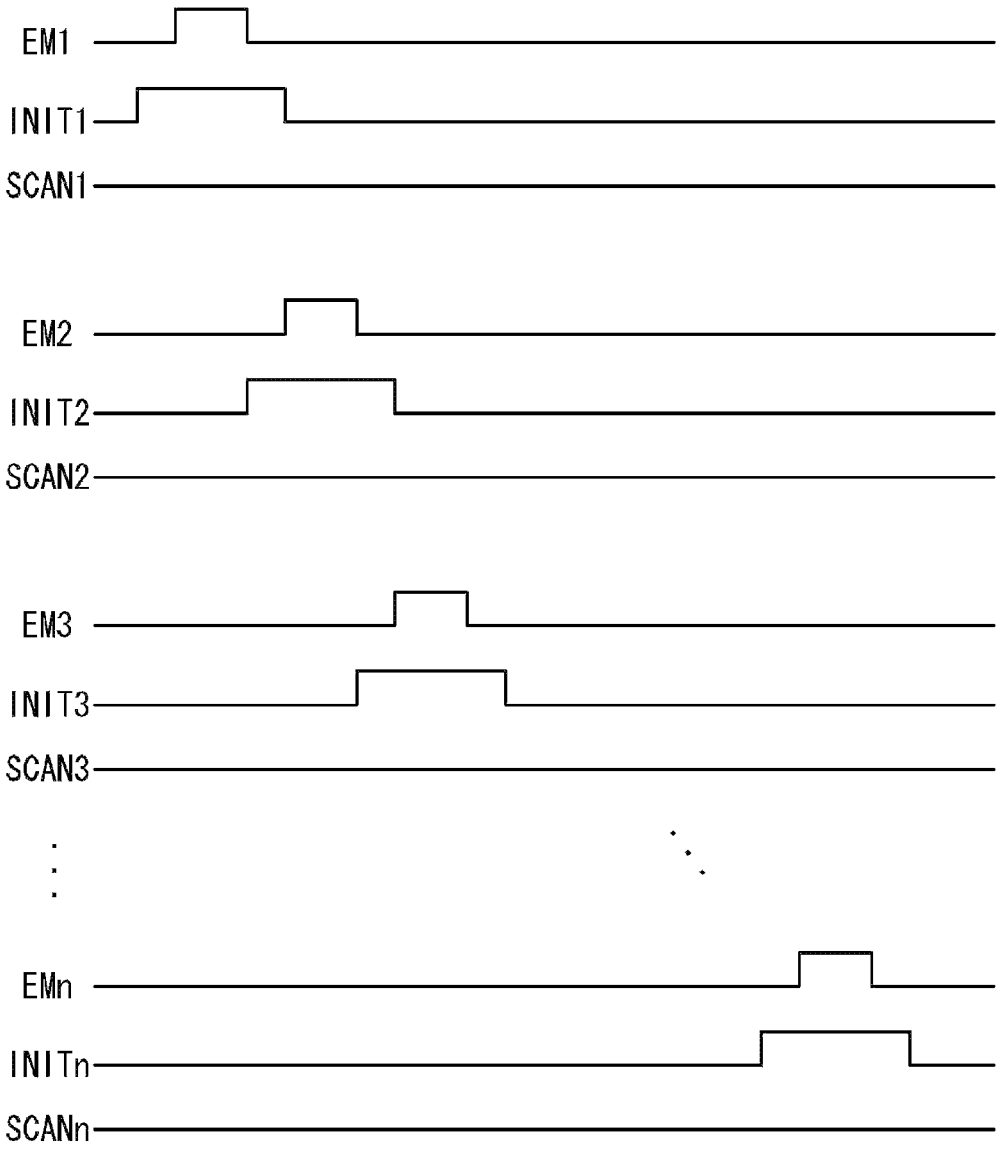

FIGS. 7 and 8 are waveform diagrams for explaining an operation of erasing an image sticking by initializing pixels P and suppressing light emission in a method of erasing an image sticking of an organic light emitting display according to a second exemplary embodiment of the present invention.

Referring to FIGS. 7 and 8, the timing controller 11 modulates the gate timing control signal GDC so as not to generate a second pulse P2 of an emission control signal EM and a scan signal SCAN at a power-off start point in time at which the power input signal EL_ON changes to the low logic level.

The data driving circuit 12 outputs no data voltage because no data is input from the timing controller 11 at all during the power-off delay time Toff. The gate driving circuit 13 generate a first pulse of the emission control signal EM and an initialization signal NIT to initialize the pixels P during the power-off delay time Toff under the control of the timing controller 11, and sequentially shifts the signals as shown in FIG. 8. The gate driving circuit 13 does not output the second pulse P2 of the emission control signal EM during the power-off delay time Toff under the control of the timing controller 11, and does not generate pulses of the scan signal SCAN in synchronization with a data voltage.

The pixels P are discharged in response to the signals EM (P1) and NIT shown in FIGS. 7 and 8 during the power-off delay time Toff. In each of the pixels P, nodes A, B, and C are discharged by being connected to a ground voltage source. The OLEDs of the pixels P do not emit light sine they are maintained in the off state during the power-off delay time Toff.

Figure 9:
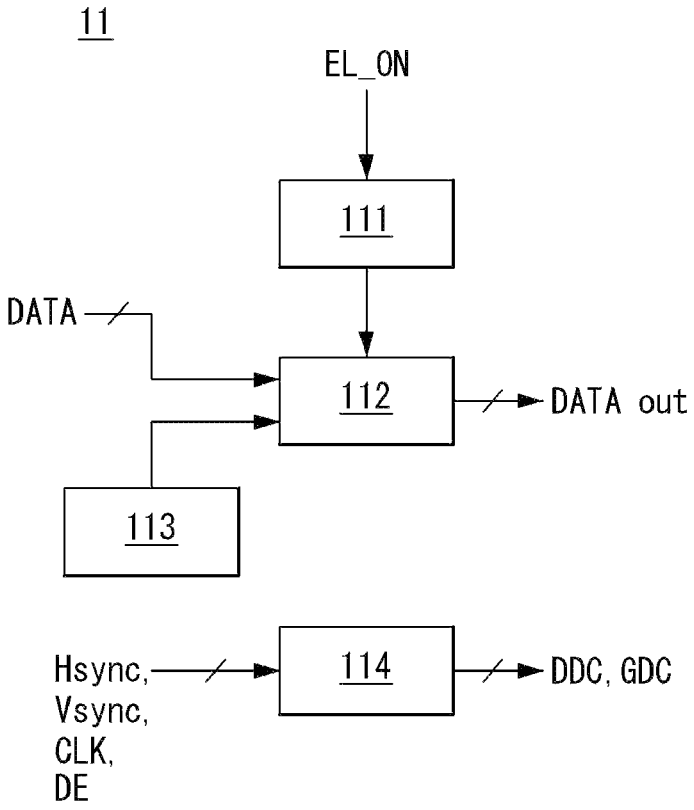
FIG. 9 is a block diagram showing the configuration of a timing controller for implementing the method of erasing an image sticking of an organic light emitting display according to the first exemplary embodiment of the present invention.

FIG. 9 is a block diagram showing the configuration of a timing controller for implementing the method of erasing an image sticking of an organic light emitting display according to the first exemplary embodiment of the present invention.

Referring to FIG. 9, the timing controller 11 comprises a power sensing unit 111, a data alignment unit 112, a register 113, and a timing control signal generator 114.

The power sensing unit 111 senses a voltage change in the power input signal EL_ON and outputs a power on/off signal for indicating a power-on state or power-off state.

The data alignment unit 112 receives digital video data of an input image and digital black data for image sticking erasure. The data alignment unit 112 aligns data in accordance with the pixel array of the display panel 10. The data alignment unit 112 selects digital video data of an input image in response to a first logic level of the power on/off signal input from the power sensing unit 111, and transmits it to the data driving circuit 12. On the other hand, the data alignment unit 112 selects digital black data for image sticking erasure in the power-off delay time Toff in response to a second logic level of the power on/off signal input from the power sensing unit 111, and transmits it to the data driving circuit 12. The digital black data is preset irrespective of the input image and stored in the internal register 113 of the timing controller 11.

The timing control signal generator 114 receives timing signals, such as a vertical synchronization signal Vsync, a horizontal synchronization signal Hsync, a main clock signal CLK, and a data enable signal DE, and counts the timing signals to generate a data timing control signal DDC and a gate timing control signal GDC. In the method of erasing an image sticking of an organic light emitting display according to the first exemplary embodiment of the present invention, the data timing control signal DDC and the gate timing control signal GDC are not modulated in the power-off sequence process. Accordingly, in the method of erasing an image sticking of an organic light emitting display according to the first exemplary embodiment of the present invention, the data driving circuit 12 and the gate driving circuit 13 operate normally, like in the power-on state, during the power-off delay time Toff to thereby write black data to the pixels P and erase an image sticking.

Figure 10:
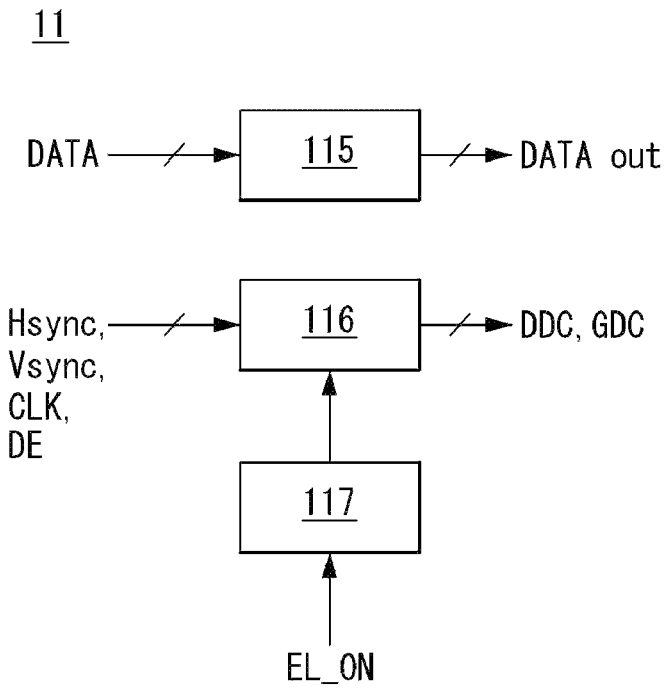
FIG. 10 is a block diagram showing the configuration of a timing controller for implementing the method of erasing an image sticking of an organic light emitting display according to the second exemplary embodiment of the present invention.

FIG. 10 is a block diagram showing the configuration of a timing controller for implementing the method of erasing an image sticking of an organic light emitting display according to the second exemplary embodiment of the present invention.

Referring to FIG. 10, the timing controller 11 comprises a power sensing unit 117, a data alignment unit 115, and a timing control signal generator 116.

The power sensing unit 117 senses a voltage change in the power input signal EL_ON and outputs a power on/off signal for indicating a power-on state or power-off state.

The data alignment unit 115 receives digital video data of an input image, aligns the data in accordance with the pixel array of the display panel 10, and then transmits it to the data driving circuit 12.

The timing control signal generator 116 receives timing signals, such as a vertical synchronization signal Vsync, a horizontal synchronization signal Hsync, a main clock signal CLK, and a data enable signal DE, and counts the timing signals to generate a data timing control signal DDC and a gate timing control signal GDC so that the waveforms of FIG. 5 are generated in the power-on state in which the first logic level of the power on/off signal is maintained. The timing control signal generator 116 modulates the gate timing control signal GDC to generate the signals of FIGS. 7 and 8 at a power-off start point in time, in response to a second logic level of the power on/off signal input from the power sensing unit 117. In one example of the modulation method, the start pulse of a scan signal SCAN is not generated, and only a first pulse of the start pulse of an emission control signal EM is generated but a second pulse thereof is not generated. The start pulse of the emission control signal EM comprises first and second pulses P1 and P2, as is the case for the emission control signal EM, in the power-on state. If only the first pulse is included in the modulated start pulse of the emission control signal EM, the emission control signal EM comprises only the first pulse P1 for initializing the pixels P, as shown in FIGS. 7 and 8.

Figure 11:
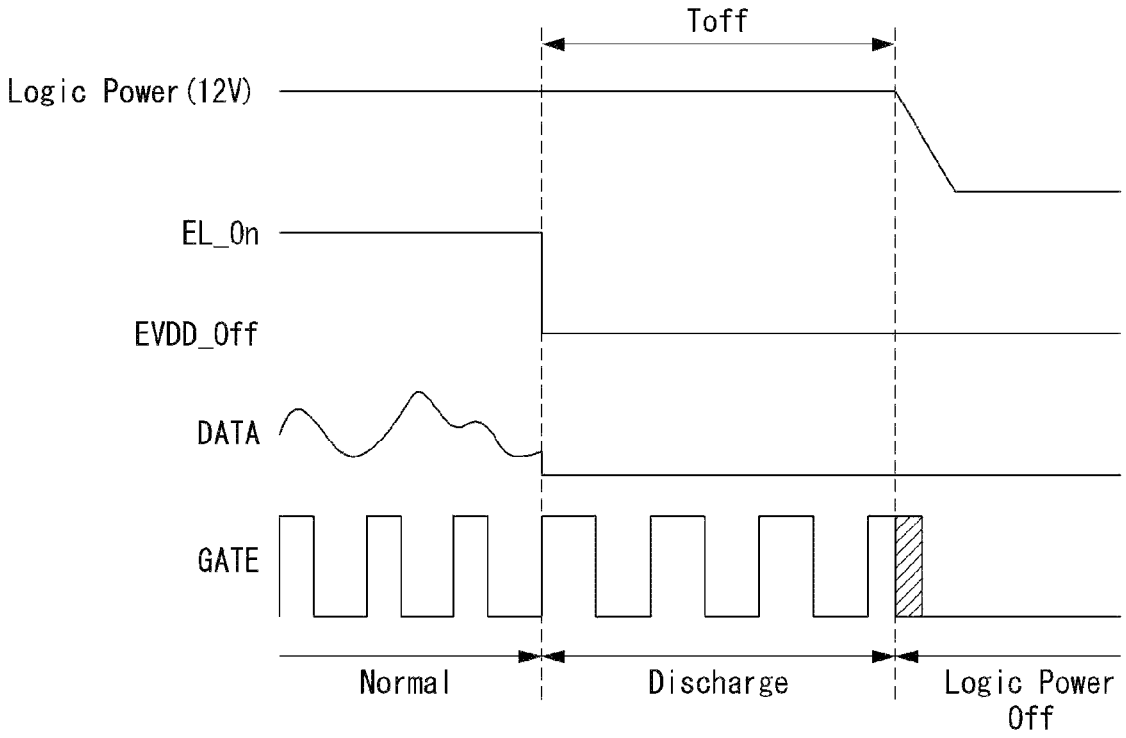
FIG. 11 is a waveform diagram showing an example in which gate signals are applied when a logic power supply voltage decreases.

If the gate driving circuit 13 outputs gate signals until the logic power supply voltage decreases, as shown in FIG. 11, the output of the gate driving circuit 13 abnormally fluctuates due to a fluctuation in the logic power supply voltage, whereby the waveforms of the gate signals may be distorted in a certain line of the display panel 10 and charges may be accumulated in the pixels P due to the voltage of the gate signals. As a result, undesired charges are accumulated in the pixels P, and these charges add weight to the stress of the TFTs, thereby causing variations and degradations in the threshold voltage. Once an output is produced from the gate driving circuit 13 while the logic power supply voltage is decreasing or even after the logic power supply voltage is dropped to 0 V (see the slash pattern of FIG. 11), the organic light emitting display is turned on again and an image is displayed on the display panel 10. Hereupon, stripe-shaped noise may appear in a certain line of the display panel.

Figure 12:
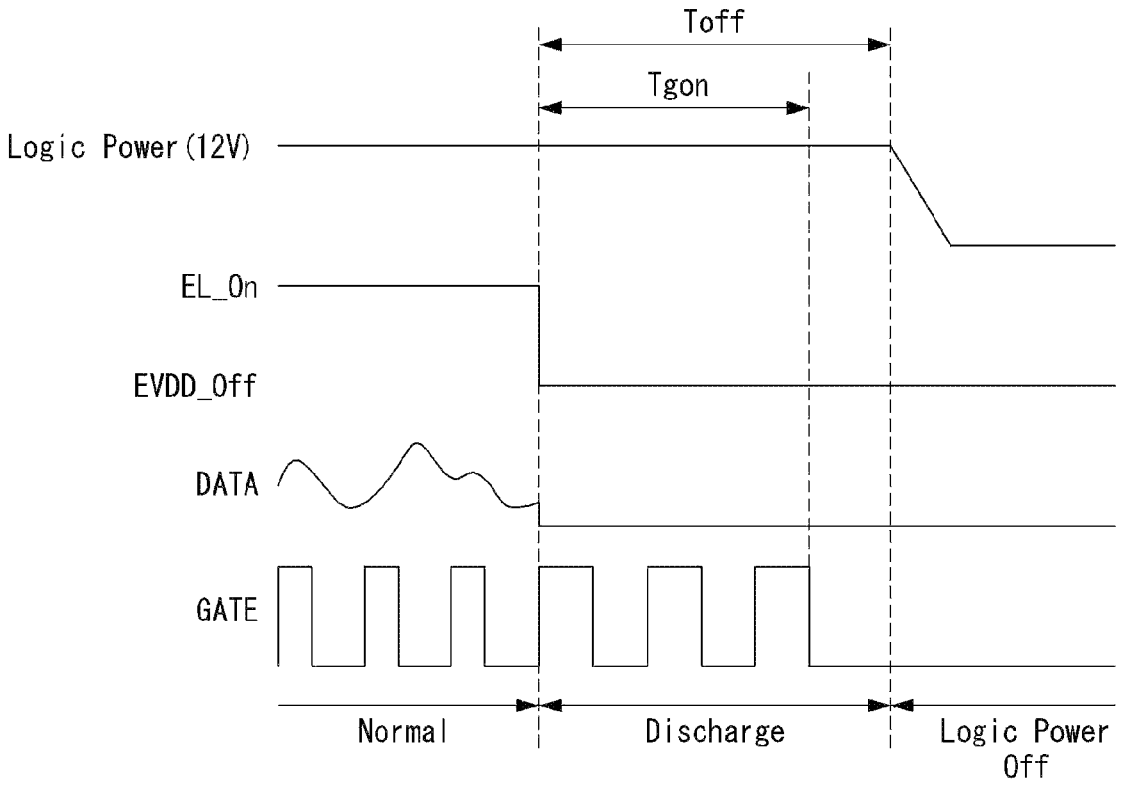
FIG. 12 is a waveform diagram showing an example in which the output of the gate signals is not generated before the logic power supply voltage decreases.

In the present invention, gate signals are normally output from the gate driving circuit 13 only while the logic power supply voltage is maintained at 12 V within the power-off delay time Toff of the gate, and the output of the gate driving circuit 13 is disabled before the logic power supply voltage starts to decrease. To this end, the timing controller 11 counts a gate-on time Tgon, which is set to be shorter than a period of time from the power-off start point in time to the power-off delay time Toff, and stops the output of the gate timing control signal GDC when the gate-on time Tgon is reached. Then, the gate driving circuit 13 produces no output, as shown in FIG. 12, because the gate timing control signal GDC, that is, a gate start pulse GSP, a gate shift clock GSC, and a gate output enable signal GOE, is not input.

The foregoing image sticking erasing method according to the present invention can be applied to a method of writing black grayscale data to pixels for black data insertion driving in the power-on state. The black data insertion driving involves writing black data after a predetermined period of time after data of an input image is written to the pixels.

The image sticking erasing method of the present invention is applicable to a method of writing black data to pixels in order to reduce 3D crosstalk in the power-on state of a shutter glasses-type stereoscopic image display apparatus. The "3D crosstalk" refers to a viewer perceiving the left and right-eyed images displayed on the display panel with a single eye (left eye or right eye) at the same time, so that the user perceives overlap of the images. In the shutter glasses-type stereoscopic image display apparatus, the left and right-eyed images displayed on the display panel are time-divided, and the left-eye shutter and right-eye shutter of the shutter glasses are opened/closed in synchronization with image data displayed on the display panel. In the shutter glasses-type stereoscopic image display apparatus, black grayscale data is written to pixel data during a reset frame period inserted between a frame period for writing left-eye image data and a frame period for writing right-eye image data, in order to reduce 3D crosstalk. The image sticking erasing method of the present invention may be applied in the reset frame period in the shutter glasses-type stereoscopic image display apparatus, thereby displaying black grayscales on the pixels.

As discussed above, the present invention makes it possible to erase an image sticking of the organic light emitting display in the power-off sequence process by discharging the pixels during the power-off delay time in which the panel driving circuit is driven since the power-off start point in time when the power-off sequence is started.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising:

a display panel having data lines, gate lines crossing the data lines, and pixels comprising organic light emitting diodes, wherein the pixels receive a high-potential power supply voltage;

a panel driving circuit for writing data to the display panel; and a power supply unit which generates a logic power supply voltage required to drive the panel driving circuit, maintains the output of the logic power supply voltage until a predetermined period of power-off delay time has elapsed after a power input signal decreases from a high logic level to a low logic level, and drops the logic power supply voltage after the power-off delay time, wherein the panel driving circuit senses a change in a power input signal and is driven by the logic power supply voltage during the power-off delay time to supply preset black data to the pixels or supply gate signals to the pixels to discharge the pixels, and when the power input signal decreases from the high logic level to the low logic level, the high-potential power supply voltage is dropped to a ground potential so that the pixels do not emit light.

2. The organic light emitting display of claim 1, wherein the panel driving circuit comprises:

a data driving circuit for supplying a data voltage to the data lines;

a gate driving circuit for sequentially supplying the gate signals to the gate lines; and a timing controller that controls the operation timing of the data driving circuit and the operation timing of the gate driving circuit, and controls the discharge timing of the pixels by sensing a change in the power input signal and driving the data driving circuit and the gate driving circuit during the power-off delay time.

3. The organic light emitting display of claim 2, wherein the timing controller transmits digital black data, which is preset to erase an image sticking, irrespective of an input image, to the data driving circuit during the power-off delay time, the data driving circuit converts the digital black data into a gamma compensation voltage during the power-off delay time to generate a black data voltage and supply the black data voltage to the data lines, and the gate driving circuit sequentially supplies the gate signals comprising a scan signal, in synchronization with the black data voltage, to the gate lines during the power-off delay time.

4. The organic light emitting display of claim 3, wherein the gate driving circuit stops the output of the gate signals within the power-off delay time before the logic power supply voltage starts to decrease.

5. The organic light emitting display of claim 4, wherein, when a gate-on time is reached, the timing controller stops the output of a gate timing control signal for controlling the operation timing of the gate driving circuit, the gate-on time being set to be shorter than a period of time from a power-off start point in time to the power-off delay time.

6. The organic light emitting display of claim 3, wherein the panel driving circuit is characterized in that:

the gate lines are divided into scan lines, emission lines, and initialization lines;

the gate signals are divided into a scan signal sequentially supplied to the scan lines, first and second pulses of an emission control signal sequentially supplied to the emission lines, and an initialization signal sequentially sup plied to the initialization lines; and the initialization signal overlaps the emission control signal.

7. The organic light emitting display of claim 6, wherein the timing controller generates a data timing control signal for controlling the operation timing of the data driving circuit and a gate timing control signal for controlling the operation timing of the gate driving circuit, and modulates the gate timing control signal at a power-off start point in time, and the gate driving circuit outputs the other gate signals, except the scan signal and the second pulse of the emission control signal, during the power-off delay time in response to the modulated gate timing control signal.

8. The organic light emitting display of claim 7, wherein the data driving circuit outputs no data voltage during the power-off delay time.

9. The organic light emitting display of claim 7, wherein the gate driving circuit stops the output of the gate signals within the power-off delay time before the logic power supply voltage starts to decrease.

10. The organic light emitting display of claim 9, wherein, when a gate-on time is reached, the timing controller stops the output of a gate timing control signal for controlling the operation timing of the gate driving circuit, the gate-on time being set to be shorter than a period of time from the power-off start point in time to the power-off delay time.

11. A method of erasing an image sticking of an organic light emitting display, the method comprising:

generating a logic power supply voltage required to drive a panel driving circuit, and supplying a high-potential power supply voltage to pixels;

maintaining the output of the logic power supply voltage during a predetermined period of power-off delay time, after a power input signal is inverted from a high logic level to a low logic level, to drive the panel driving circuit;

sensing a change in the power input signal; and driving the panel driving circuit by the logic power supply voltage during the power-off delay time to supply preset black data to the pixels or supply gate signals to the pixels to discharge the pixels, wherein when the power input signal decreases from the high logic level to the low logic level, the high-potential power supply voltage is dropped to a ground potential so that the pixels do not emit light.

12. An organic light emitting display comprising:

a display panel having data lines, gate lines crossing the data lines, and pixels comprising organic light emitting diodes;

a panel driving circuit for writing data to the display panel; and a power supply unit which generates a logic power supply voltage required to drive the panel driving circuit, maintains the output of the logic power supply voltage until a predetermined period of power-off delay time has elapsed after a power input signal decreases from a high logic level to a low logic level, and drops the logic power supply voltage after the power-off delay time, wherein the panel driving circuit senses a change in a power input signal and is driven by the logic power supply voltage during the power-off delay time to supply preset black data to the pixels or supply gate signals to the pixels to discharge the pixels, and wherein the gate lines are divided into scan lines, emission lines, and initialization lines, the gate signals are divided into a scan signal sequentially supplied to the scan lines, first and second pulses of an emission control signal sequentially supplied to the emission lines, and an initialization signal sequentially supplied to the initialization lines, and the initialization signal overlaps the emission control signal.

13. The organic light emitting display of claim 12, wherein the panel driving circuit comprises:

wherein the pixels receives a high-potential power supply voltage, and when the power input signal decreases from the high logic level to the low logic level, the high-potential power supply voltage is dropped to a ground potential so that the pixels do not emit light.

14. The organic light emitting display of claim 13, wherein the panel driving circuit comprises:

a data driving circuit for supplying a data voltage to the data lines;

a gate driving circuit for sequentially supplying the gate signals to the gate lines; and a timing controller that controls the operation timing of the data driving circuit and the operation timing of the gate driving circuit, and controls the discharge timing of the pixels by sensing a change in the power input signal and driving the data driving circuit and the gate driving circuit during the power-off delay time.

15. The organic light emitting display of claim 14, wherein the timing controller transmits digital black data, which is preset to erase an image sticking, irrespective of an input image, to the data driving circuit during the power-off delay time, the data driving circuit converts the digital black data into a gamma compensation voltage during the power-off delay time to generate a black data voltage and supply the black data voltage to the data lines, and the gate driving circuit sequentially supplies the gate signals comprising a scan signal, in synchronization with the black data voltage, to the gate lines during the power-off delay time.

16. The organic light emitting display of claim 15, wherein the gate driving circuit stops the output of the gate signals within the power-off delay time before the logic power supply voltage starts to decrease.

17. The organic light emitting display of claim 15, wherein, when a gate-on time is reached, the timing controller stops the output of a gate timing control signal for controlling the operation timing of the gate driving circuit, the gate-on time being set to be shorter than a period of time from a power-off start point in time to the power-off delay time.

18. The organic light emitting display of claim 17, wherein the timing controller generates a data timing control signal for controlling the operation timing of the data driving circuit and a gate timing control signal for controlling the operation timing of the gate driving circuit, and modulates the gate timing control signal at a power-off start point in time, and the gate driving circuit outputs the other gate signals, except the scan signal and the second pulse of the emission control signal, during the power-off delay time in response to the modulated gate timing control signal.

19. The organic light emitting display of claim 18, wherein the data driving circuit outputs no data voltage during the power-off delay time, and wherein the gate driving circuit stops the output of the gate signals within the power-off delay time before the logic power supply voltage starts to decrease.

20. The organic light emitting display of claim 19, wherein, when a gate-on time is reached, the timing controller stops the output of a gate timing control signal for controlling the operation timing of the gate driving circuit, the gate-on time being set to be shorter than a period of time from the power-off start point in time to the power-off delay time.

* * * * *